US009153152B1

(12) United States Patent
Elmer

(10) Patent No.: US 9,153,152 B1
(45) Date of Patent: Oct. 6, 2015

(54) MAGNETIC MOUNTING ASSEMBLY AND METHOD

(71) Applicant: Steven W. Elmer, Winter Park, FL (US)

(72) Inventor: Steven W. Elmer, Winter Park, FL (US)

( * ) Notice: Subject to any disclaimer, the term of this patent is extended or adjusted under 35 U.S.C. 154(b) by 260 days.

(21) Appl. No.: 13/788,389

(22) Filed: Mar. 7, 2013

Related U.S. Application Data

(60) Provisional application No. 61/610,611, filed on Mar. 14, 2012.

(51) Int. Cl.
*G09F 21/04* (2006.01)
*G09F 7/04* (2006.01)
*A47G 1/17* (2006.01)

(52) U.S. Cl.
CPC *G09F 21/04* (2013.01); *A47G 1/17* (2013.01); *G09F 7/04* (2013.01); *G09F 2021/041* (2013.01); *Y10T 24/32* (2015.01)

(58) Field of Classification Search
CPC ..... Y10T 24/32; F16B 2/00; A47G 1/17; G09F 21/04; G09F 7/04; G09F 2021/041
USPC ..... 24/303; 248/309.4, 206.5; 40/600
See application file for complete search history.

(56) References Cited

U.S. PATENT DOCUMENTS

| | | | |
|---|---|---|---|
| 823,459 | A | 6/1906 | Batchelor |
| 914,775 | A | 3/1909 | Aarons |
| 1,140,107 | A | 5/1915 | Brown |
| 1,151,219 | A | 8/1915 | Scherer |
| 1,250,197 | A | 12/1917 | Louppe |
| 1,314,053 | A | 8/1919 | Eissler |
| 1,359,492 | A | 11/1920 | Demuth |
| 1,443,945 | A | 2/1923 | Cappell |
| 1,463,326 | A | 7/1923 | Kristofek |
| 1,510,783 | A | 10/1924 | Johnson |
| 1,700,383 | A | 1/1929 | Smigielski |
| 1,895,197 | A | 1/1933 | Martinson |
| 2,020,702 | A | 11/1935 | Russell |
| 2,077,585 | A | 4/1937 | Rivers |
| D105,553 | S | 8/1937 | Scholl |
| D132,468 | S | 5/1942 | Leuer |
| 2,316,055 | A | 4/1943 | Davey |
| 2,559,163 | A | 7/1951 | MacDonald |
| 2,675,983 | A | 4/1954 | King |
| 2,816,377 | A | 12/1957 | Hastings |
| 2,825,799 | A | 3/1958 | Julien |

(Continued)

FOREIGN PATENT DOCUMENTS

| | | |
|---|---|---|
| AU | 248832 | 1/1964 |
| CA | 20441396 | 10/1992 |
| GB | 2124008 | 2/1984 |

OTHER PUBLICATIONS

Pizza Hut, Trademark Registration No. 2,396,061, Oct. 17, 2000.

*Primary Examiner* — Robert J Sandy
(74) *Attorney, Agent, or Firm* — Allen Dyer Doppelt Milbrath & Gilchrist

(57) ABSTRACT

A magnetic assembly and method permitting the use of low-cost magnets capable of being fabricated in an efficient and low-cost manner having a plate having a mounting surface and an opposing bottom surface, with a plurality of magnetizable elements, each of which is fitted in a fixture having plural radial wings for holding the magnetizable elements against the mounting surface, and with an over mold of a plastic material covering the mounting surface, the fixture and the bottom surface.

6 Claims, 8 Drawing Sheets

(56) References Cited

U.S. PATENT DOCUMENTS

| | | | | |
|---|---|---|---|---|
| 2,960,786 | A | 11/1960 | Wagner | |
| 3,082,982 | A | 3/1963 | Moskowitz | |
| 3,153,294 | A | 10/1964 | Hay et al. | |
| 3,208,173 | A | 9/1965 | Shank | |
| 3,225,475 | A | 12/1965 | Shank | |
| 3,234,677 | A | 2/1966 | McDaniel et al. | |
| 3,239,957 | A | 3/1966 | Snediker | |
| 3,242,329 | A | 3/1966 | Abrams | |
| 3,245,165 | A | 4/1966 | Podoloff | |
| D205,209 | S | 7/1966 | Priddis | |
| 3,284,938 | A | 11/1966 | Diehl et al. | |
| 3,290,813 | A | 12/1966 | Rose | |
| D207,240 | S | 3/1967 | Stevens et al. | |
| 3,370,302 | A | 2/1968 | Karlyn | |
| 3,440,748 | A | 4/1969 | Hackley | |
| 3,471,958 | A | 10/1969 | Westin | |
| 3,507,245 | A | 4/1970 | Grabow | |
| 3,633,299 | A | 1/1972 | Westin | |
| 3,715,821 | A | 2/1973 | Hawes | |
| 3,779,436 | A | 12/1973 | Burland | |
| 3,828,455 | A | 8/1974 | Bentley | |
| 3,828,456 | A | 8/1974 | Rose | |
| 3,905,324 | A | 9/1975 | English | |
| 3,911,497 | A | 10/1975 | Lewis, Jr. et al. | |
| 3,916,816 | A | 11/1975 | Fitch | |
| 3,924,272 | A | 12/1975 | Allen et al. | |
| 3,936,967 | A | 2/1976 | Davis | |
| D245,940 | S | 9/1977 | George | |
| 4,052,806 | A | 10/1977 | George | |
| 4,062,073 | A | 12/1977 | Rhee | |
| D246,937 | S | 1/1978 | Smith | |
| 4,084,338 | A | 4/1978 | Ross | |
| D250,555 | S | 12/1978 | Belokin, Jr. | |
| 4,190,902 | A | 3/1980 | Rhee | |
| 4,198,708 | A | 4/1980 | Fugere et al. | |
| D255,726 | S | 7/1980 | Leuthesser | |
| D256,419 | S | 8/1980 | Hom | |
| 4,226,669 | A | 10/1980 | Vilardi | |
| 4,231,501 | A | 11/1980 | Goode | |
| 4,292,627 | A | 9/1981 | Knight | |
| 4,412,495 | A | 11/1983 | Sankar | |
| D271,984 | S | 12/1983 | Nelson et al. | |
| D277,298 | S | 1/1985 | Nelson | |
| D277,299 | S | 1/1985 | Nelson | |
| 4,587,754 | A | 5/1986 | Ossner | |
| 4,646,873 | A | 3/1987 | Bryson | |
| 4,667,428 | A | 5/1987 | Elmer | |
| D290,620 | S | 6/1987 | Elmer | |
| 4,671,004 | A | 6/1987 | Berg | |
| 4,688,343 | A | 8/1987 | Allan | |
| 4,839,975 | A | 6/1989 | Elmer | |
| 4,843,947 | A | 7/1989 | Bauer | |
| D312,097 | S | 11/1990 | Robinson | |
| 4,976,410 | A | 12/1990 | Tomaiuolo | |
| 4,995,186 | A | 2/1991 | Collie | |
| 5,056,155 | A | 10/1991 | Truxell | |
| 5,084,994 | A | 2/1992 | Elmer | |
| D327,333 | S | 6/1992 | Elmer | |
| D328,143 | S | 7/1992 | Elmer | |
| 5,210,970 | A | 5/1993 | Elmer | |
| 5,241,703 | A | 9/1993 | Roberts et al. | |
| D347,023 | S | 5/1994 | Cunningham | |
| 5,323,728 | A | 6/1994 | Hjelm | |
| 5,339,551 | A | 8/1994 | Elmer | |
| D368,934 | S | 4/1996 | Elmer | |
| D380,072 | S | 6/1997 | Correll | |
| D386,091 | S | 11/1997 | Caulk | |
| D386,208 | S | 11/1997 | Caulk | |
| 5,711,100 | A | 1/1998 | Elmer | |
| 5,787,622 | A | 8/1998 | Green et al. | |
| 5,918,397 | A | 7/1999 | Elmer | |
| 5,932,942 | A | 8/1999 | Patyk et al. | |
| D418,930 | S | 1/2000 | De Leon | |
| D429,766 | S | 8/2000 | Elmer | |
| D433,067 | S | 10/2000 | Manley | |
| D433,454 | S | 11/2000 | Elmer | |
| D447,774 | S | 9/2001 | Elmer et al. | |
| 6,305,656 | B1 * | 10/2001 | Wemyss | 248/309.4 |
| 6,491,271 | B1 | 12/2002 | Adams | |
| 6,496,588 | B1 | 12/2002 | Chang | |
| D476,690 | S | 7/2003 | Elmer | |
| D480,432 | S | 10/2003 | Newman | |
| 6,729,591 | B2 | 5/2004 | Hsu | |
| 6,739,567 | B1 | 5/2004 | Curtis | |
| 6,762,527 | B1 | 7/2004 | Horng | |
| 6,868,630 | B2 | 3/2005 | Kim | |
| 7,155,851 | B2 | 1/2007 | Ootsuka | |
| D567,876 | S | 4/2008 | Au et al. | |
| D568,941 | S | 5/2008 | Elmer et al. | |
| 7,455,501 | B2 * | 11/2008 | Horng et al. | 415/220 |
| 7,618,013 | B2 | 11/2009 | Elmer et al. | |
| D617,384 | S | 6/2010 | Elmer | |
| 8,146,279 | B2 | 4/2012 | Elmer | |
| 8,978,213 | B2 * | 3/2015 | Hayton | 24/303 |
| 2005/0178033 | A1 * | 8/2005 | Elmer et al. | 40/600 |
| 2006/0000130 | A1 | 1/2006 | Gajdacs | |

* cited by examiner

MAGNETIC MOUNTING ASSEMBLY AND METHOD

RELATED APPLICATION

This application claims priority from provisional application Ser. No. 61/610,611, filed Mar. 14, 2012.

BACKGROUND

Magnetic housing assemblies are used with magnetic advertising signs for automotive vehicles. Because the magnets must withstand forces taking place during the vehicle's motion without becoming dislodged, a strong construction is necessary; however, because the signs are used as temporary fixtures and are frequently removed from vehicles, magnet strength must not be so high as to defeat removal. Therefore for certain applications, it is desirable to use a plurality of thinner, lower-cost, magnets arranged in a permanent fashion inside a housing, so that the magnetic force is distributed across the housing's surface area.

To assure that the magnets do not shift during construction of the assembly and during use, it is necessary to permanently fix the magnets in place. Although glue is used as one method to fix magnets in place, the glue must be able to withstand high temperatures to which the finished housing will be subjected. Use of high temperature glue is relatively expensive as well as unnecessary for the routine use of the magnet. In order to avoid these problems alternate solutions are desirable. An earlier version of a magnetic assembly for automotive signs is disclosed in U.S. Pat. No. 7,618,013, a disclosure of this is incorporated here by reference.

SUMMARY

The present invention is directed to an improved magnetic assembly and method that permits the use of low cost magnets to be utilized in fabricating a magnetic mounting assembly useful, for example, in the attachment of signs to automobiles. One significant feature of this invention is the ability to fabricate the magnetic assembly efficiently and in a low cost manner.

In accordance with this invention, the magnetic assembly utilizes a base plate of a magnetizable metal having an inner surface and a side wall, and with plural magnetizable elements disposed on the inner wall. A magnet positioning fixture is provided with indentations for receiving the magnet elements, so as to hold the elements in proper position during assembly. The plate, the fixture and the magnets are over molded with a plastic cover forming an upper coating and a lower coating joined together along a side wall of the plate. The magnetizable elements are then magnetized.

Preferably, the plate is provided with apertures that permit the insertion of positioning pins that hold the plate and fixture in place during the over molding process. The plate, the fixture and the upper and lower coatings are provided with aligned central openings to permit a fastener to be inserted through the magnet assembly and engage an advertising sign of similar article after the magnet elements are properly magnetized.

BRIEF DESCRIPTION OF THE DRAWINGS

A preferred embodiment of the invention is described by way of example with reference to the accompanying drawings in which.

DETAILED DESCRIPTION OF THE PREFERRED EMBODIMENT

The present invention will now be described more fully with reference to the accompanying drawings in which preferred embodiments of the invention are shown and described. It is to be understood that the invention may be embodied in many different forms and should not be construed as limited to the illustrated embodiments set forth herein. Rather, these embodiments are provided so that this disclosure may be thorough and complete, and will convey the scope of the invention to those skilled in the art.

Figure 1:
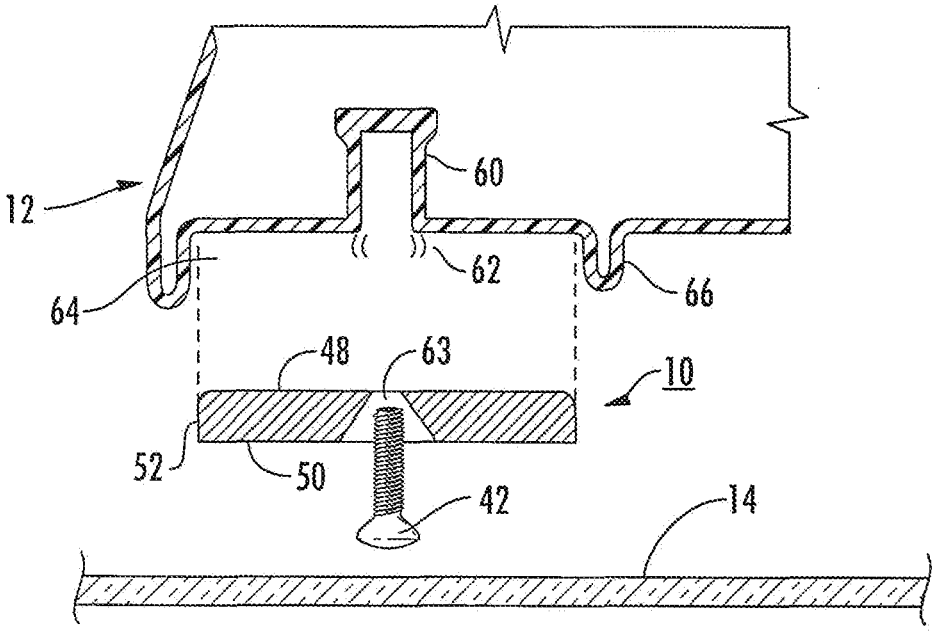
FIG. 1 is a partial exploded cross-sectional view of a magnet assembly made according to the present invention attached to a portion of an advertising sign.

With reference initially to FIG. 1, one embodiment of the invention is a magnet assembly 10 useful in removably attaching a sign 12 to a metallic structure 14, such as the roof of a motor vehicle used in transporting an advertising sign. The assembly 10 in accordance with the present invention is installed through use of a fastener 42 into a molded extension 60 of the advertising sign 12, with a flexible sleeve 62 interposed between the assembly 10 and a recess 64 in a lower portion 66 of the sign 12.

Figure 2:
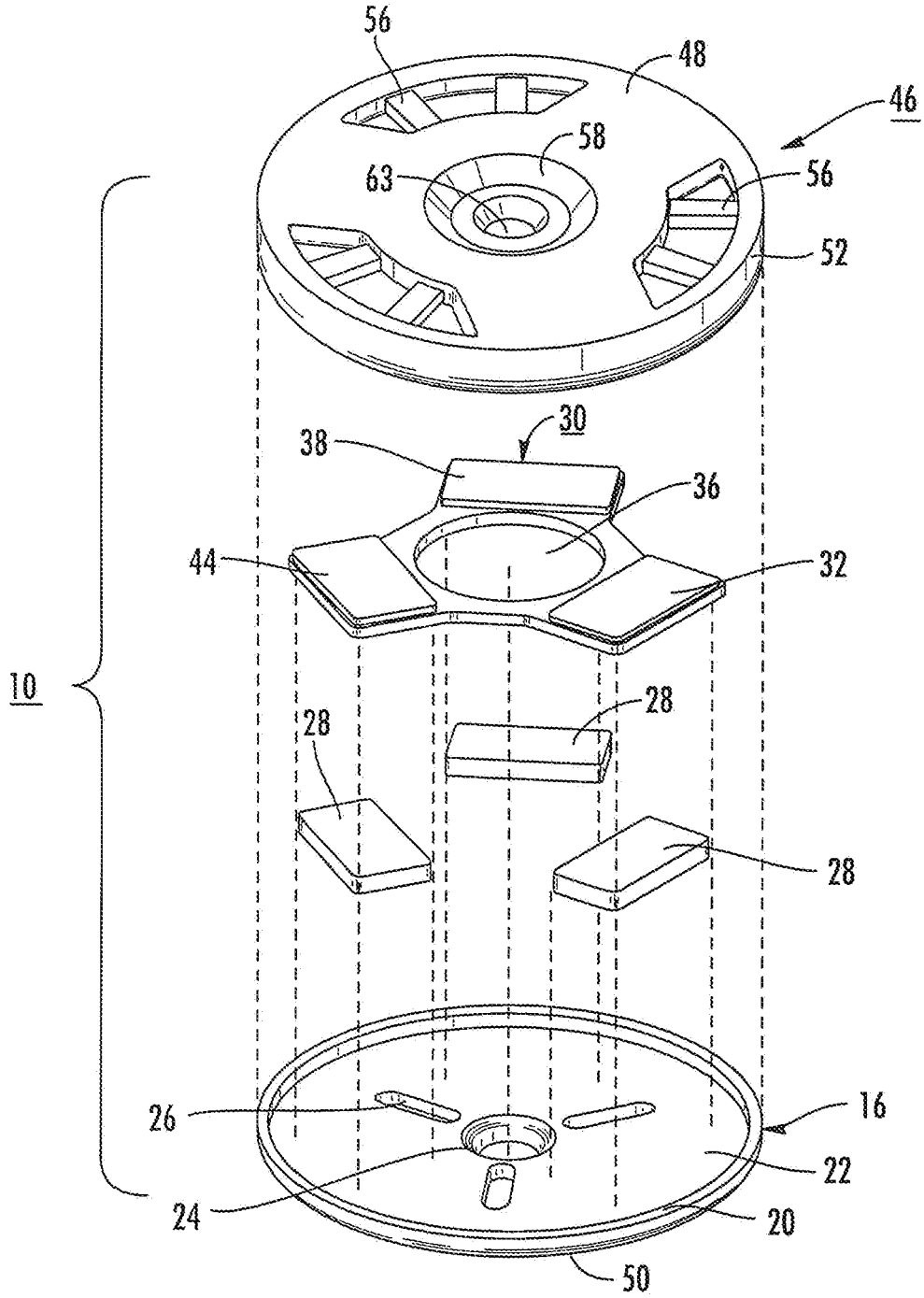
FIG. 2 depicts in an exploded view an exemplary configuration of the magnet assembly in accordance with the present invention.
Figure 3:
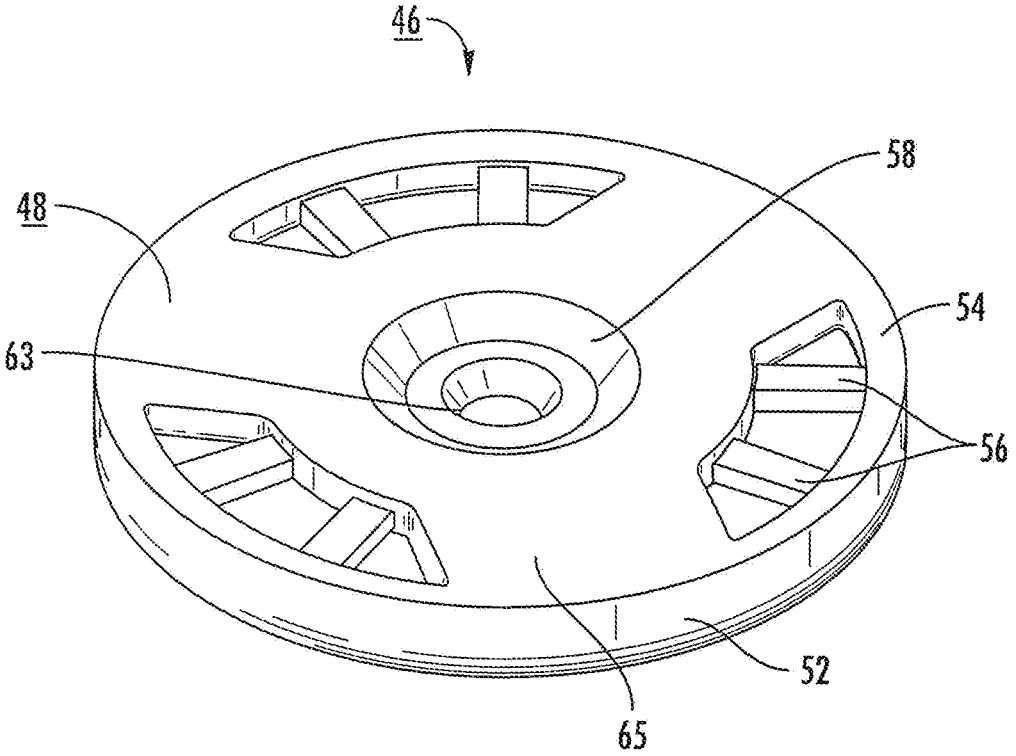
FIGS. 3 and 4 are, respectively, a perspective view of the top and a plan view of the bottom of a sealed magnet assembly according to FIG. 2.
Figure 4:
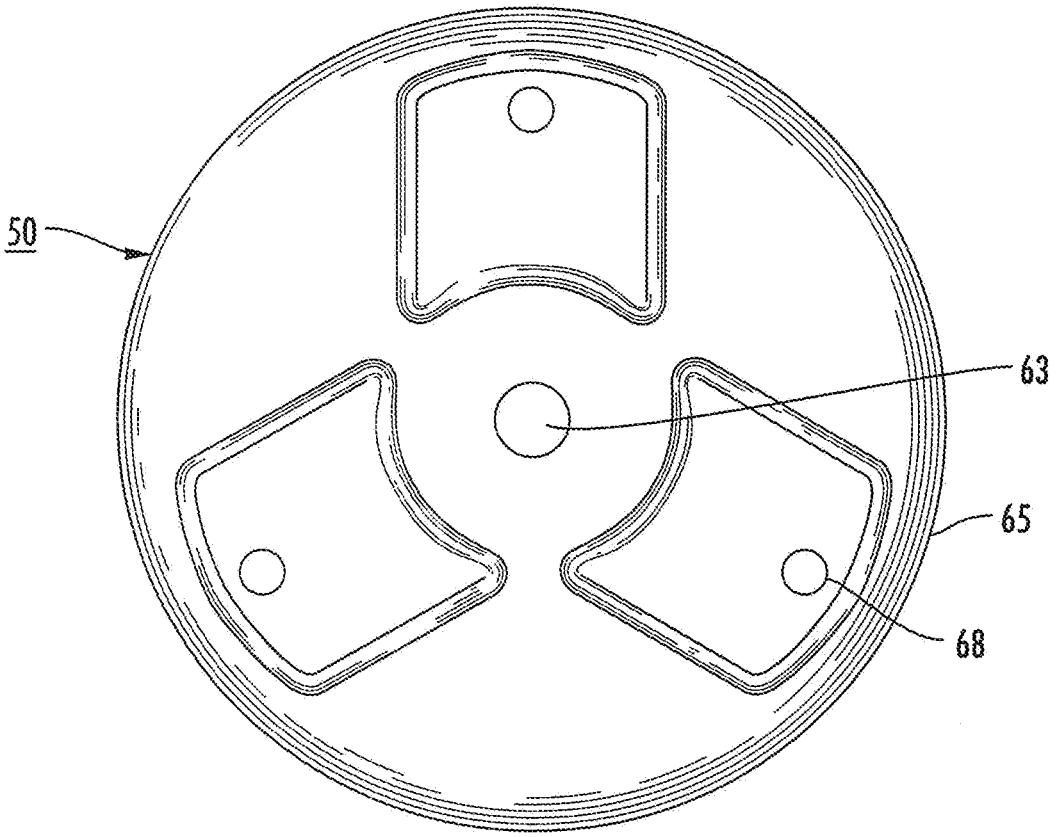

Now noting FIG. 2, the magnet assembly 10 comprises the following elements: a plate 16 having a side wall 20 and an inner mounting surface 22, a central opening 24 and slots 26 through which positioning pins may be inserted during the over molding process. The assembly 10 further includes plural magnet elements 28 that may be placed on the surface 22 of the plate 16 prior to being magnetized, thereby making the fabrication of the assembly 10 much more easily controlled. A magnet fixture 30 is placed snugly over the magnet elements 28 and across the inner wall 22 of the plate 16, with the fixture 30 being defined by plural wings 38 as described further below. Once assembled and held in place by positioning pins extending through openings 26 of the plate 16, the entire assembly 10 is over molded with an upper coating 46 and a lower coating 50 as is shown in FIGS. 3 and 4. In this example, three magnet elements 28 are placed across the surface 22 with each magnet 28 between adjacent slots 26. Preferably, the plate 16 is cylindrical in shape.

Figure 5:
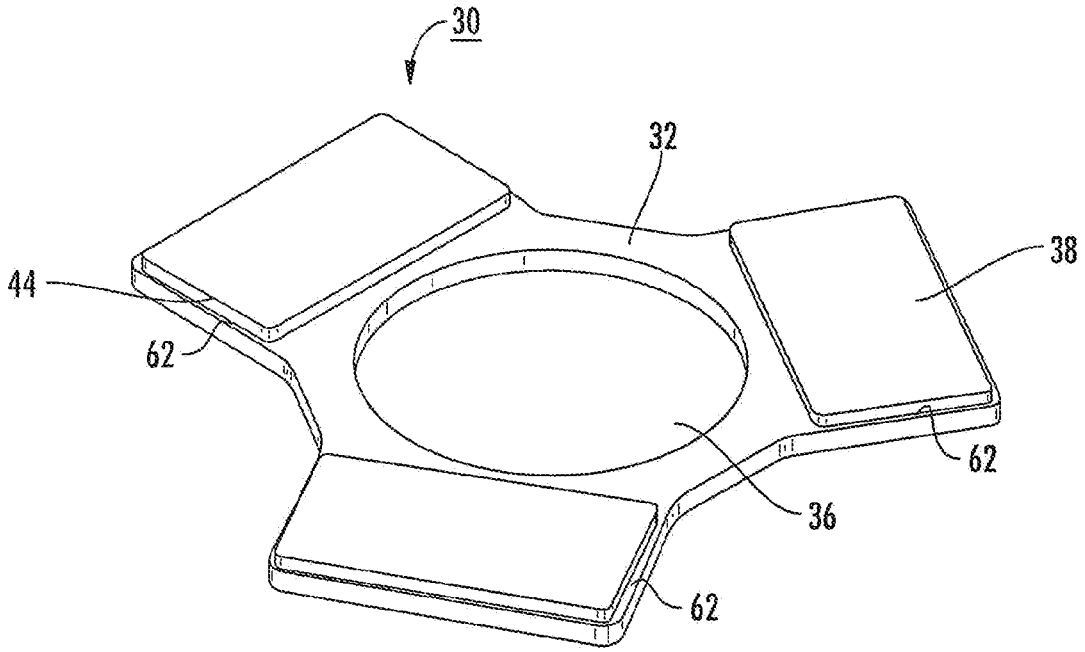
FIGS. 5 and 6 are, respectively, top and bottom perspective views of a magnet fixture shown generally as element 30 in FIG. 2.
Figure 6:
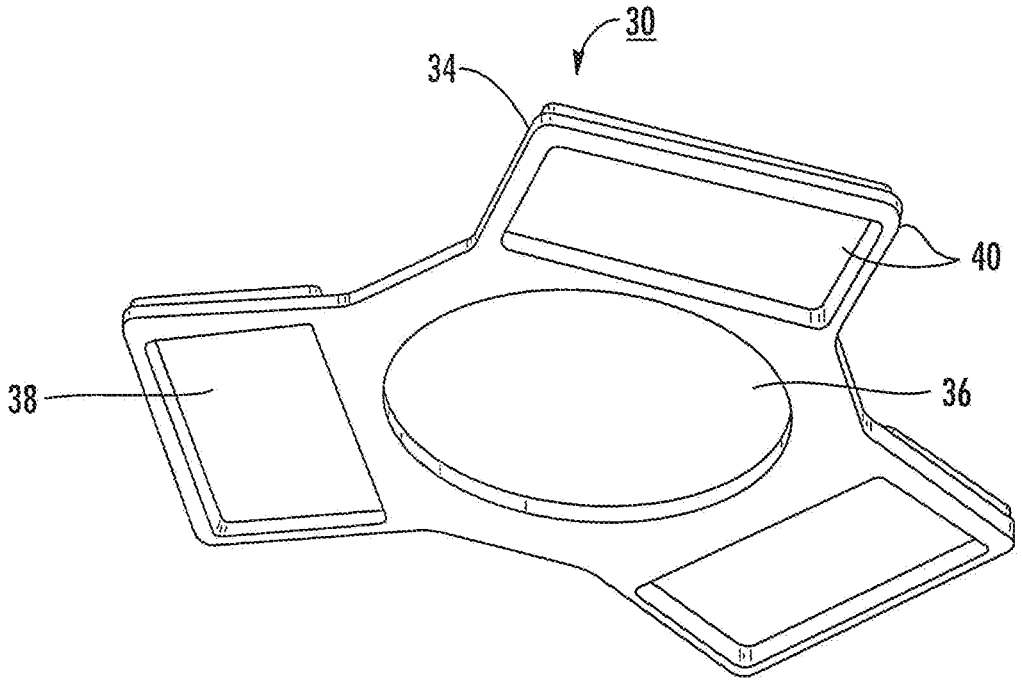
Figure 7:
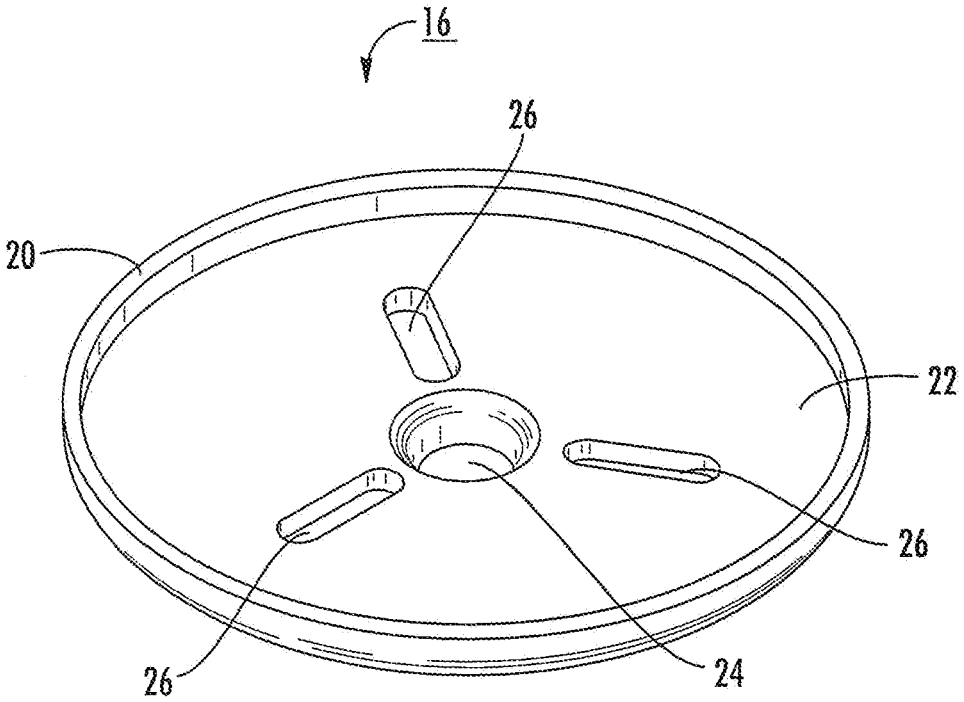
FIG. 7 is a perspective view of a mounting plate of the assembly shown as element 16 in FIG. 2.
Figure 8:
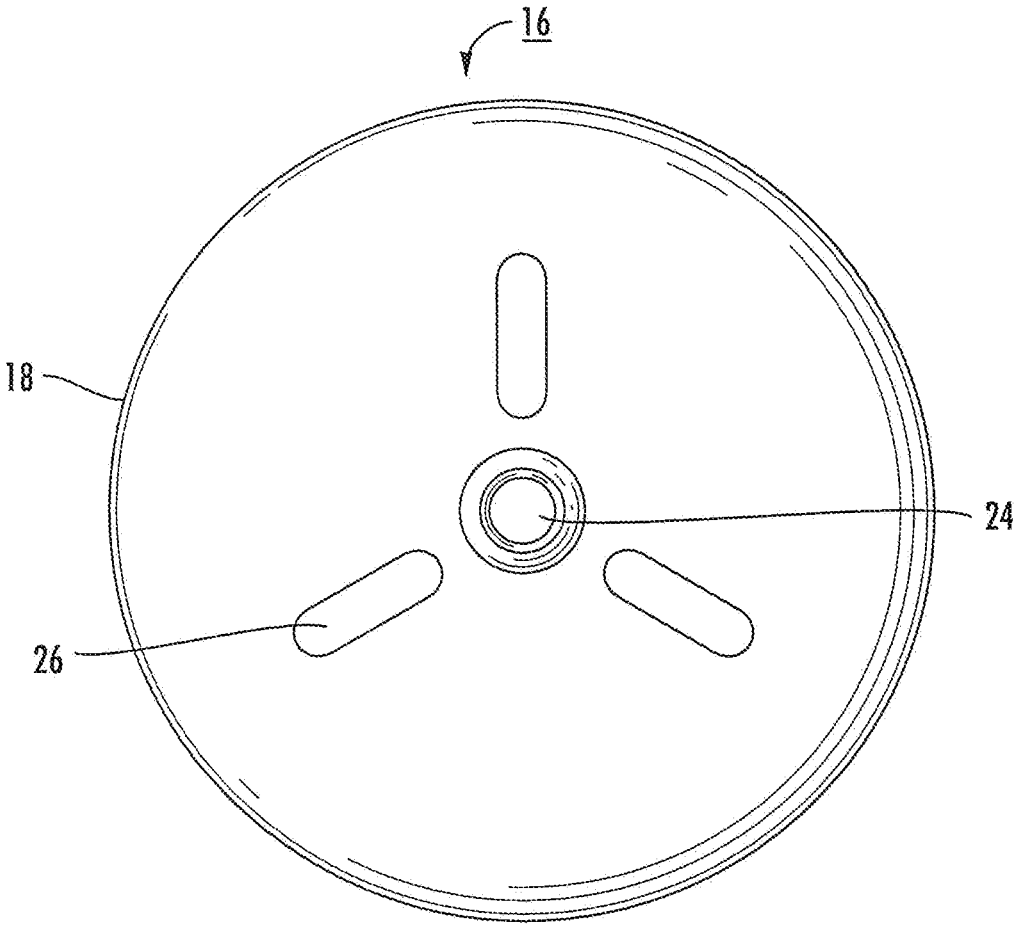
FIG. 8 is a bottom view of the mounting plate 16 shown in FIG. 7.

As illustrated in FIG. 2, the magnet fixture 30 is placed snugly over the magnet elements 28 and the inner surface 22 of plate 16. As a result, the transverse and longitudinal movement of each magnet element 28 is limited by the fixture 30. Referring to FIGS. 5 and 6, the fixture 30 comprises a top side 32, a bottom side 34, a central opening 36 and a plurality of wings 38 that are spanned outwardly from the central opening 36. As shown in FIGS. 5 and 6, the fixture 30 comprises a non-metallic and non-magnetic material, with the fixture made of plastic. The bottom side 34 of the fixture 30 has indentations 40 that snugly engage with the magnet elements 28 through wings 38. The wings 38 at the bottom side 34 include corresponding indentations 40 dimensioned to accommodate the magnet elements 28. The fixture 30, and in particular the wings 38, provides a uniform and even surface for equal distribution of the magnets 28 on the bottom inner surface 22 of the plate 16.

The plate 16 and the fixture 30 each include a central opening (24 and 36, respectively) cooperating to receive the fastener 42 therethrough, such as the screw illustrated by way of example with reference again to FIG. 1, when fastening the mounting assembly 10 to an object such as the sign 12.

In the embodiment of FIG. 2, the plastic overcoating 46 is defined by an upper coating 48, a lower coating 50 and a sidewall coating 52. The upper coating 48 is in seamless contact with the side wall 22 of the plate 16. The upper coating 48 carries crimps or tabs 56. The tabs 56 extend from the peripheral portion 54 of the upper coating 48 for providing a compression-fit contact between the housing 16 and the magnets 28. The upper coating 48 further comprises a central indentation 58 and a central opening 60 in the center of the central indentation 58. As herein described and as illustrated in FIGS. 3 and 4, the central indentation 58 and the central opening 60 are formed in the center of the upper coating 48, and are cylindrical in shape.

The upper coating 48 further comprises a plurality of apertures 62 having similar shapes as the magnet elements 28 and the wings 38, but fractionally larger in dimension than the corresponding magnet elements 28 and wings 38. When the upper coating 48 is formed over the cover 30, the cover 30 rests with its top side 32 touching the inside surface 22 of the plate 16. Accordingly, the coatings 48 and 50 hold the plate 16 and the fixture 30 in place and provide a structural framework during fabrication and overmolding of the assembly 10.

As shown in FIG. 4, the lower coating 50 is cylindrical in shape, comprises a central opening 63 and plural pin holes or slots 68 to permit the use of pins to hold the assembly unit in place during assembly of the plate 16, the magnets 28, the fixture 30 and the overmolding of the upper and lower covers 48 and 50.

When fully assembled, only outside surfaces of the upper coating 48, the outside surface of the lower coating 50, and a circumferential outside surface 52 along side wall 20 are exposed. The fastener 42 is extended through the central opening 63 of the upper and lower coatings 48 and 50 when fastening the magnet assembly 10 to an object such as the sign 12.

In one specific example, the coatings 48 and 50 comprise a material such as polyolefin or thermal plastic with a durometer rating between about 60-90, or any other similar polymeric coating depending on the contemplated application. After fabrication the completed magnet assembly 10 may then be subjected to a magnetic field, which magnetizes the magnet elements 28.

FIG. 2 illustrates an individual polygonal-shaped magnet 28 which may be used in the completed assembly 10. A person skilled in the art will recognize that magnets come in a number of shapes including toroidal, semi-toroidal as well as various polygonal and irregular shapes. The shape shown is illustrative of these possibilities. In one specific embodiment, the magnet elements 28 are each a rectangular prism, and by way of example only, is on the order of 1"×0.5"×0.125" in size. The magnets 28 may comprise neodymium or any other suitable magnetizable material. The plate 16 is a circular disk in shape, and may be made of steel coated with zinc plating, for example.

With regard to the method of assembly, reference is again made to FIG. 2 where the plate 16, the magnets 28, and the fixture 30 are assembled and oriented as illustrated. In this illustration, the wall 22 is shown with the central opening 24 and plurality of apertures 26 facing the inside surface 22 of the plate 16. As illustrated in FIG. 2, the magnet elements 28, or a substrate capable of being magnetized, are then inserted in the plate 16, with the bottom surface of each magnet resting on the surface 22. In a next step, the fixture 30 is inserted into the plate 16 in which the magnet elements 28 have previously been placed. The central opening 36 of the fixture 30 is aligned with the central opening 24 of the plate 16. In the next step, the coatings 46 and 50 are deposited in a mold to cover the assembly 10.

With reference again to FIG. 1, the assembly 10 is used to removably fasten the advertising sign 12 to the structure 14 such as a surface of a vehicle. In that regard, a portion of the sign as disclosed in U.S. Pat. No. 5,711,100 is illustrated in FIG. 1 by way of example, the entire specification and drawings for which are incorporated herein by reference.

Many modifications and other embodiments of the invention will come to the mind of one skilled in the art having the benefit of the teachings presented in the foregoing descriptions and the associated drawings. Therefore, it is to be understood that the invention is not to be limited to the specific embodiment disclosed, and that modifications and alternate embodiments are intended to be included within the scope of this invention.

The invention claimed is:

1. A magnet assembly comprising:

a plate having a mounting surface and an opposing bottom surface;

a plurality of magnetizable elements;

a non-metallic fixture having means for holding the magnetizable elements against the mounting surface in spaced relation; and an over mold of a plastic material covering the mounting surface and the fixture.

2. The magnet assembly recited in claim 1 wherein the magnetizable element holding means of the fixture comprises a surface dimensioned to fit in abutment with the mounting surface, with plural spaced indentations in the fixture surface, each indentation dimensioned to receive a magnetizable element.

3. The magnet assembly recited in claim 2 wherein the fixture comprises radial wings across and in contact with the mounting surface, each wing having one of the indentations facing the mounting surface.

4. The magnet assembly recited in claim 1 wherein the plate and the fixture both have mutually aligned openings therein dimensioned to receive a fastener.

5. The magnet assembly recited in claim 1 further comprising the over mold covering the side wall and the bottom surface.

6. A magnetizable assembly, comprising:

a plate having a substantially flat interior mounting surface and a peripheral side wall;

plural magnetizable elements that have not been magnetized in spaced relation across the mounting interior surface;

a fixture for fixing the elements in the spaced relation; and a coating over the mounting surface and the fixture inside the side wall.

* * * * *